US010788256B2

(12) United States Patent
Kojima et al.

(10) Patent No.: US 10,788,256 B2
(45) Date of Patent: Sep. 29, 2020

(54) COOLING DEVICE

(71) Applicant: Mitsubishi Electric Corporation, Tokyo (JP)

(72) Inventors: Tomonori Kojima, Tokyo (JP); Hideki Ono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/094,274

(22) PCT Filed: Jun. 20, 2016

(86) PCT No.: PCT/JP2016/068198
§ 371 (c)(1),
(2) Date: Oct. 17, 2018

(87) PCT Pub. No.: WO2017/221287
PCT Pub. Date: Dec. 28, 2017

(65) Prior Publication Data

US 2019/0128590 A1 May 2, 2019

(51) Int. Cl.
*F25D 21/00* (2006.01)
*F25B 41/04* (2006.01)
(Continued)

(52) U.S. Cl.
CPC ..... *F25D 21/002* (2013.01); *F25B 13/00* (2013.01); *F25B 41/04* (2013.01); *F25B 49/02* (2013.01);
(Continued)

(58) Field of Classification Search
CPC ..... F25D 21/002; F25D 21/06; F25B 41/04; F25B 2600/2501; F25B 47/022;
(Continued)

(56) References Cited

U.S. PATENT DOCUMENTS 4,831,834 A * 5/1989 Yoshida ..... F25B 47/022 62/126
4,854,130 A * 8/1989 Naruse ..... F25B 41/04 62/352
5,193,353 A * 3/1993 Brendel ..... B60H 1/00014 62/196.4
5,319,940 A * 6/1994 Yakaski ..... F25B 47/022 62/151
5,860,286 A * 1/1999 Tulpule ..... G05B 23/0254 62/129
(Continued)

FOREIGN PATENT DOCUMENTS

JP H11-325654 A 11/1999
JP 2007-225258 A 9/2007
(Continued)

OTHER PUBLICATIONS

International Search Report of the International Searching Authority dated Sep. 13, 2016 for the corresponding international application No. PCT/JP2016/068198 (and English translation).

*Primary Examiner* — Kun Kai Ma
(74) *Attorney, Agent, or Firm* — Posz Law Group, PLC

(57) ABSTRACT

A cooling device is capable of protecting an electronically controlled expansion valve in a main refrigerant circuit from the liquid hammer phenomenon due to high-pressure liquid refrigerant when cooling operation starts. The cooling device includes a main refrigerant circuit, a defrosting refrigerant circuit, and a controller. In the main refrigerant circuit, a compressor, a condenser, a main opening-closing
(Continued)

valve, an expansion valve in which the flow rate of refrigerant is variable, and an evaporator are connected via refrigerant pipes. The defrosting refrigerant circuit connects the refrigerant outlet side of the compressor in the main refrigerant circuit and the refrigerant inlet side of the evaporator in the main refrigerant circuit to each other and includes a valve mechanism.

6 Claims, 4 Drawing Sheets

(51) Int. Cl.

| | |
|---|---|
| ***F25B 49/02*** | (2006.01) |
| ***F25B 13/00*** | (2006.01) |
| ***F25D 21/06*** | (2006.01) |
| ***F25B 47/02*** | (2006.01) |

(52) U.S. Cl.
CPC ..... *F25D 21/06* (2013.01); *F25B 47/022* (2013.01); *F25B 2500/00* (2013.01); *F25B 2600/23* (2013.01); *F25B 2600/2501* (2013.01); *F25B 2600/2513* (2013.01); *F25B 2700/173* (2013.01); *F25B 2700/197* (2013.01); *F25B 2700/21163* (2013.01)

(58) Field of Classification Search
CPC .. F25B 49/02; F25B 13/00; F25B 2600/2513; F25B 2700/21163; F25B 2700/197; F25B 2700/173
See application file for complete search history.

(56) References Cited

U.S. PATENT DOCUMENTS

| | | | | |
|---|---|---|---|---|
| 2007/0137228 | A1* | 6/2007 | Li | F25B 47/022 62/196.4 |
| 2008/0041079 | A1* | 2/2008 | Nishijima | F25B 5/00 62/191 |
| 2012/0011866 | A1* | 1/2012 | Scarcella | F25B 1/10 62/79 |
| 2012/0262881 | A1* | 10/2012 | Onimaru | B60L 3/003 361/701 |
| 2013/0098092 | A1* | 4/2013 | Wakamoto | F25B 1/10 62/278 |
| 2016/0273795 | A1* | 9/2016 | Takenaka | F24F 11/30 |
| 2018/0202691 | A1* | 7/2018 | Saito | F25B 13/00 |

FOREIGN PATENT DOCUMENTS

| | | | |
|---|---|---|---|
| JP | 2008-241238 | A | 10/2008 |
| JP | 4476946 | B2 | 6/2010 |

* cited by examiner

| DEGREE OF SUBCOOLING (SC) | SOLENOID VALVE 10-A | SOLENOID VALVE 10-B | SOLENOID VALVE 11 | SOLENOID VALVE 3 | ELECTRONICALLY CONTROLLED EXPANSION VALVE 4 |
|---|---|---|---|---|---|
| 20 < SC | OPEN | OPEN | OPEN | OPEN | MAXIMUM OPENING |
| 10 < SC < 20 | OPEN | CLOSE | OPEN | OPEN | MAXIMUM OPENING |
| SC < 10 | CLOSE | CLOSE | CLOSE | OPEN | MAXIMUM OPENING |

| DEGREE OF SUBCOOLING (SC) | ELECTRONICALLY CONTROLLED EXPANSION VALVE 12 | SOLENOID VALVE 3 | ELECTRONICALLY CONTROLLED EXPANSION VALVE 4 |
|---|---|---|---|
| 20 < SC | MAXIMUM OPENING | OPEN | MAXIMUM OPENING |
| 10 < SC < 20 | HALF OPEN | OPEN | MAXIMUM OPENING |
| SC < 10 | CLOSE | OPEN | MAXIMUM OPENING |

COOLING DEVICE

CROSS REFERENCE TO RELATED APPLICATION

This application is a U.S. national stage application of International Application No. PCT/JP2016/068198, filed on Jun. 20, 2016, the contents of which are incorporated herein by reference.

TECHNICAL FIELD

The present invention relates to a cooling device and, in particular, to protection of an expansion valve from the liquid hammer phenomenon due to high-density, high-pressure refrigerant when cooling operation starts, as well as to control performed to suppress generation of unusual sounds.

BACKGROUND

A solenoid valve and an expansion valve that are installed in a conventional cooling device are separated from each other or independent of each other, and in a refrigerant circuit, the valves are connected using a pipe. When the temperature in a refrigerator (refrigerator compartment) increases, and an instruction to start operation is output, a closed solenoid valve is opened to cause refrigerant to flow out through the solenoid valve. Here, the refrigerant held back by the solenoid valve is in a subcooled state because of low-temperature air in the refrigerator, and the refrigerant flows into the refrigerant circuit with the density of the refrigerant kept high. In the subcooled state, liquid refrigerant does not boil at a temperature below a saturation temperature, that is, refrigerant does not change from a liquid state to a gas state at a temperature below a saturation temperature. With an increase in the degree of subcooling, the density of the refrigerant is increased. An extreme pressure shock caused when the subcooled high-density refrigerant collides with the expansion valve is known as liquid hammer.

A cooling device is known in which, in order to prevent the liquid hammer phenomenon, an electronically controlled expansion valve is used as a solenoid valve, and a solenoid valve is provided on the downstream side of the electronically controlled expansion valve, thereby achieving improvement in the cooling device (e.g., refer to Patent Literature 1).

The liquid hammer phenomenon relates to the density of liquid-state refrigerant or liquid refrigerant, and with an increase in the liquid density, the impact pressure is increased. Thus, to decrease impact pressure, a method of incorporating control to decrease the liquid density in a refrigerating device has been presented. Specifically, a refrigerating device capable of performing control so that subcooling of liquid refrigerant is suppressed has been proposed (e.g., refer to Patent Literature 2).

Another refrigerating device has been proposed in which, in order to enable heating, a heater is wound around a pipe provided on the upstream side of a solenoid valve, and the temperature of liquid refrigerant is increased by heating the liquid refrigerant, thereby decreasing the liquid density of the liquid refrigerant (e.g., refer to Patent Literature 3).

PATENT LITERATURE

Patent Literature 1: Japanese Unexamined Patent Application Publication No. 2008-241238

Patent Literature 2: Japanese Unexamined Patent Application Publication No. 2007-225258 (Japanese Patent No. 4476946)

Patent Literature 3: Japanese Unexamined Patent Application Publication No. 11-325654

Recent years have seen an increase in the use of high-density refrigerants such as CO2, for example, to save energy, prevent ozone depletion, prevent global warming, or for other purposes. In most refrigerants for use in refrigerating and air-conditioning devices, HCFCs and HFCs have replaced chlorofluorocarbons (CFCs). For HCFCs, although HCFCs are not as harmful as CFCs, they are still capable of depleting the ozone layer. Some representative HFCs, as alternatives to CFCs, have a strong greenhouse effect instead of having the potential to destroy the ozone layer. In terms of global warming prevention, when an HFC used as a refrigerant leaks while being used or disposed and is accidentally emitted into the atmosphere, the HFC is considered to contribute to global warming even if the total emission of the HFC is less than that of CO2.

Thus, increasing attention has been paid to high-density refrigerants. The liquid hammer phenomenon is deeply connected to the density of liquid refrigerant, and as the liquid refrigerant density is increased, the generated impact pressure is also increased. For instance, when R404A and R410A are compared, R410A has a higher liquid density than R404A, and the impact pressure of R410A is around 1.4 times that of R404A. This difference in impact pressure has a significant influence on the specification of pipes to be connected and on component specification. If a component complying with an inappropriate specification in which pressure tolerance is low is used, product failure may occur before the service life of a product expires.

For instance, a solenoid valve is closed and opened four to six times per hour, that is, the solenoid valve is closed and opened 350,000 to 530,000 times for 10 years, the life span of a product. Thus, a specification that enables a product to tolerate pressure is required.

By such high impact pressure being applied repeatedly, an expansion valve may be damaged. The damage to the expansion valve stops the expansion valve from working. Thus, a normal expansion process cannot be implemented in a refrigerant circuit, leading to an increase in the temperature of a refrigerator compartment. Consequently, the quality of stored items may be degraded. Specifically, condensed high-pressure liquid refrigerant is not decompressed due to the damage to the expansion valve and does not become low-pressure liquid refrigerant. Thus, the pressure of the refrigerant does not fall below the pressure of saturated liquid, and the refrigerant does not evaporate in an evaporator. The refrigerant is no longer able to absorb the heat of the surrounding air (air in the refrigerator compartment). As a result, the temperature of the air in a refrigerator increases.

However, an extremely small opening of the expansion valve may cause a decrease in the amount of circulating refrigerant, an abnormal decease in low pressure, and an abnormal increase in the temperature of gas discharged from a compressor. This may shorten the service life of a cooling device. Furthermore, because of liquid hammer impact, an extremely high-volume abnormal sound and an abnormal vibration are caused when refrigerant collides with a component, which prompts customer complaints.

When the impact pressure is transmitted to a connected pipe to a level that exceeds the fatigue limit of the connected pipe, the connected pipe may break. When the connected pipe breaks, CFC inside the refrigerant circuit is emitted into the refrigerator. A cold and freezing storage warehouse is designed to have relatively high airtightness to suppress the outdoor air from entering, and when refrigerant in the refrigerant pipe flows into the refrigerator due to the pipe breaking, oxygen concentration in the refrigerator decreases. If a worker is working in the refrigerator, the worker will suffer from lack of oxygen, which may lead to a potentially fatal accident.

Emission of the refrigerant inside the refrigerant circuit into the atmosphere accelerates global warming and has significant adverse effects in terms of protecting the earth's environment.

Also, in the case of suppressing subcooling by heating with a heater, a larger number of heaters are required to be used as compared with the past, otherwise subcooling cannot be suppressed. If natural refrigerants such as CO2 are used in the future, the pressure of the refrigerants will increase. In such a case, there is a possibility of not being able to suppress the liquid hammer by using only heaters. Moreover, an increase in the number of heaters not only leads to mechanical and structural constraints such as the necessity to provide a space, but also leads to an increase in cost. A heater is attached to a pipe by using, for example, an adhesive sheet, and thus attaching the heater to the pipe so that the heater adheres to the pipe is a time-consuming task. When power is turned on in a cooling system, the heater that heats this pipe is always energized regardless of a cooling operation or a defrosting operation performed to melt frost formed on an indoor heat exchanger during the cooling operation. Thus, unnecessary power is consumed. Despite being a cooling device, the cooling device is constantly performing a heating operation, which is converse to the cooling operation. As a result, the coefficient of cooling performance is decreased, that is, the constant heating operation counteracts energy saving, for example. When a heater is superheating a liquid pipe, obtained subcooling of liquid refrigerant is lost due to the heater. This increases power consumption and decreases cooling capacity, consequently increasing the temperature of the refrigerator and degrading the quality of cooled items. Not only is power wasted to heat the heater, but also the heater is costly to operate. Working effectiveness is also deteriorated due to attachment of the heater.

Even if an electronically controlled expansion valve is used as a solenoid valve, there is a possibility of liquid flood back to a compressor being caused depending on the control, thereby damaging the compressor. Liquid flood back mentioned above means that liquid refrigerant flows into the compressor without becoming gas in the evaporator. For instance, when liquid refrigerant is caused to flow into the refrigerant circuit by increasing the opening degree of the electronically controlled expansion valve, the amount of circulating refrigerant increases, and the liquid refrigerant flows into the compressor without being gasified in the evaporator (liquid-back phenomenon). Thus, liquid compression occurs in the compressor, and excessive stress is generated, which may damage the inside of the compressor. When the compressor no longer works due to the damage, a normal compression process cannot be implemented in the refrigerant circuit. This may decrease the temperature of the refrigerator compartment and degrade the quality of stored items.

Because of the damage to the compressor, low-pressure refrigerant sucked by the compressor cannot be compressed, or the pressure of the low-pressure refrigerant cannot be increased. Thus, the low-pressure refrigerant cannot become high-pressure gas refrigerant. Accordingly, the pressure of the refrigerant does not exceed the pressure of saturated gas, and the refrigerant is not liquefied in the condenser. As a result, heat is not released from the refrigerant to the surrounding air, that is, the refrigerant remains as the high-pressure gas refrigerant. This means that a decompressing effect is not obtained (the refrigerant is not decompressed) in the expansion valve, that is, the refrigerant does not become low-pressure liquid refrigerant. Accordingly, the pressure of the refrigerant does not fall below the pressure of saturated liquid, and the refrigerant does not evaporate. As a result, the refrigerant is no longer able to absorb the heat of the surrounding air (air in the refrigerator compartment) in the evaporator, thereby increasing the temperature of the air in the refrigerator.

SUMMARY

The present invention has been made to solve the above-mentioned problems, and the primary objective thereof is to provide a cooling device capable of protecting an electronically controlled expansion valve in a main refrigerant circuit from the liquid hammer phenomenon due to high-pressure liquid refrigerant when the cooling operation starts.

A cooling device according to one embodiment of the present invention includes: a main refrigerant circuit in which a compressor, a condenser, a main opening-closing valve, an expansion valve, and an evaporator are sequentially connected via refrigerant pipes, the main opening-closing valve being fully opened or fully closed, and the expansion valve being a valve in which a flow rate of refrigerant is variable; a defrosting refrigerant circuit that connects a refrigerant outlet side of the compressor in the main refrigerant circuit and a refrigerant inlet side of the evaporator in the main refrigerant circuit to each other and that includes a valve mechanism in a path of the defrosting refrigerant circuit; and a controller that controls the valve mechanism in the defrosting refrigerant circuit and the expansion valve and the main opening-closing valve in the main refrigerant circuit, in which when cooling operation starts, the controller opens the valve mechanism, causes high-pressure refrigerant to flow from the compressor to the evaporator via the defrosting refrigerant circuit, and then opens the main opening-closing valve and the expansion valve and closes the valve mechanism.

When a cooling device according to an aspect of the present invention enters an operation state, a valve mechanism in a defrosting refrigerant circuit is opened to cause refrigerant to circulate through the defrosting refrigerant circuit. Thus, even if there is a pressure difference between the inlet side of a condenser and the outlet side of the condenser in a main refrigerant circuit due to subcooled refrigerant, when operation is switched to cooling operation, the pressure inside the main refrigerant circuit and the pressure outside the main refrigerant circuit can be made uniform, or a pressure difference between the two circuits can be made extremely small. Accordingly, the cooing device can suppress a liquid hammer impact force from being applied to an expansion valve in the main refrigerant circuit.

DETAILED DESCRIPTION

Embodiment 1

Figure 1:
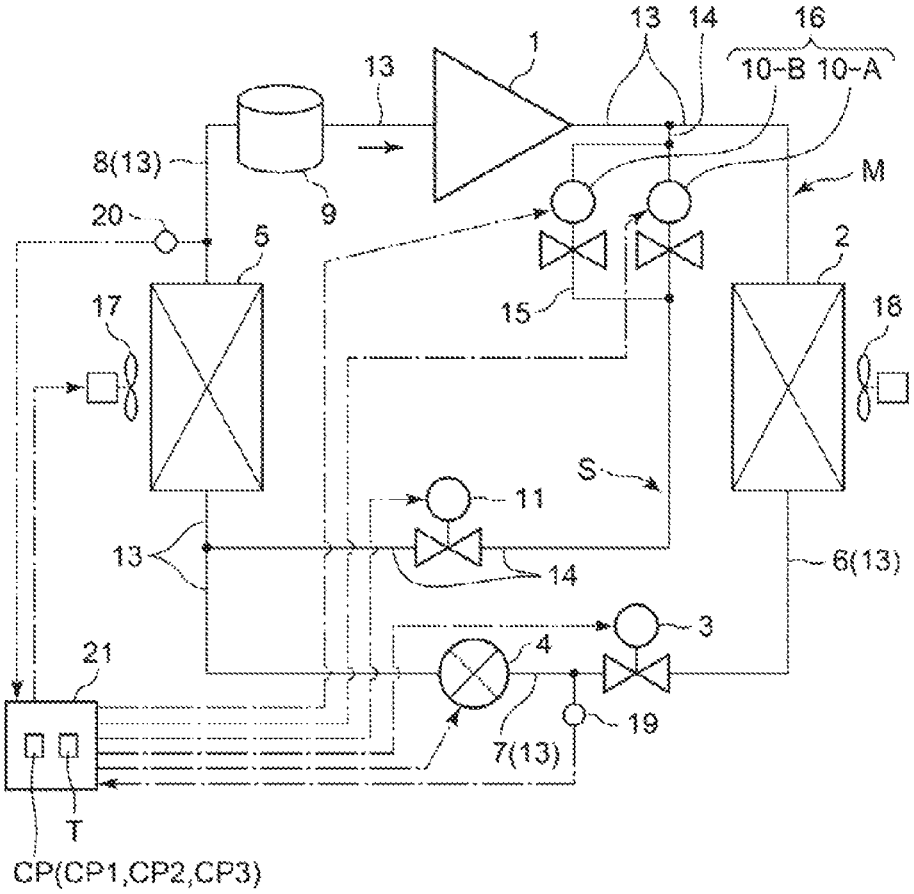
FIG. 1 is a schematic circuit block diagram showing a cooling device in Embodiment 1 of the present invention.

As shown in FIGS. 1 to 6, a cooling device according to Embodiment 1 includes a main refrigerant circuit M, a defrosting refrigerant circuit S, and a controller 21. The main refrigerant circuit M performs cooling operation. The defrosting refrigerant circuit S is connected to the main refrigerant circuit M as a bypass circuit. The controller 21 controls the driving components of the main refrigerant circuit M and the defrosting refrigerant circuit S. In the main refrigerant circuit M, a compressor 1, a condenser 2, a solenoid valve 3, an electronically controlled expansion valve 4, an evaporator 5, and an accumulator 9 are sequentially connected via refrigerant pipes 13, 13, 13 . . . . Here, the solenoid valve 3 is fully opened or fully closed. The solenoid valve 3 is a main opening-closing valve in the present invention that is controlled so that either full opening or full closing of the valve is selected in accordance with an electrical signal. The defrosting refrigerant circuit S connects the refrigerant outlet side of the compressor 1 in the main refrigerant circuit M and the refrigerant inlet side of the evaporator 5 in the main refrigerant circuit M to each other via a refrigerant pipe 14. A valve mechanism 16 is provided in the path of the defrosting refrigerant circuit S. The valve mechanism 16 includes a solenoid valve 10-A and a solenoid valve 10-B that correspond to sub-opening-closing valves in the present invention. Either full opening or full closing is selected for the solenoid valve 10-A and the solenoid valve 10-B. The two valves, the solenoid valve 10-A and the solenoid valve 10-B, are connected in parallel relative to the defrosting refrigerant circuit S by interposing a refrigerant pipe 15 therebetween. That is, the flow rate of refrigerant flowing through the defrosting refrigerant circuit S can be changed by combinations of opening or closing of the solenoid valve 10-A and opening or closing of the solenoid valve 10-B. The valve mechanism 16 is formed of the solenoid valve 10-A and the solenoid valve 10-B that have simple structures and for which simple control is performed. Thus, the valve mechanism 16 is easily available at a low cost.

The cooling device includes an air-sending fan 18, an air-sending fan 17, a subcooling degree detection unit 19, and a low-pressure detection unit 20. The air-sending fan 18 sends air to the condenser 2 in the main refrigerant circuit M. The air-sending fan 17 sends air to the evaporator 5 in the main refrigerant circuit M. The subcooling degree detection unit 19 detects degree of subcooling SC on the upstream side of the electronically controlled expansion valve 4 in the main refrigerant circuit M in the direction in which refrigerant flows. The low-pressure detection unit 20 detects pressure of refrigerant LP on the downstream side of the evaporator 5 in the main refrigerant circuit M in the direction in which the refrigerant flows.

The controller 21 includes, for example, a general-purpose microcomputer that includes components such as a controller CP, memory (not illustrated), a time counter T, and a data bus (not illustrated). The memory temporarily stores detection data and calculation data and pre-stores control program data. The time counter T measures a control time. The data bus inputs or outputs the detection data and output driving data. The controller CP implements the functions of a first control unit CP1, a second control unit CP2, and a third control unit CP3, which will be described later separately, in accordance with a control program. The first control unit CP1 has a function of controlling the driving of the valve mechanism 16 in the defrosting refrigerant circuit S and the driving of the electronically controlled expansion valve 4 and the solenoid valve 3 in the main refrigerant circuit M.

Subsequently, normal cooling operation and normal defrosting operation of the cooling device having the configuration above will be roughly explained.

When cooling operation is stopped, the solenoid valve 3 in the refrigerant circuit is closed, refrigerant flowing between the solenoid valve 3 and the compressor 1 is sucked by the compressor 1, and pressure inside the refrigerant pipes 13 between the solenoid valve 3 and the compressor 1 is made to be a reference pressure or less. Cooling operation is stopped in a state (pump down state) in which operation of the compressor 1 is stopped to protect the compressor 1. In this state, when the cooling system is turned on to start cooling operation, the solenoid valve coil of the solenoid valve 3 in the main refrigerant circuit M is energized, thereby opening the solenoid valve 3. Then, the compressor 1 sucks and compresses low-pressure gas refrigerant and sends high-temperature, high-pressure gas refrigerant to the inside of the main refrigerant circuit M. The high-temperature, high-pressure gas refrigerant discharged from the compressor 1 releases heat into the atmosphere in the condenser 2 made up of plate fins and a pipe inserted therebetween and becomes high-pressure liquid refrigerant. The refrigerant discharged from the condenser 2 flows into the electronically controlled expansion valve 4 through the solenoid valve 3. The electronically controlled expansion valve 4 decompresses and expands the high-temperature, high-pressure liquid refrigerant. The refrigerant discharged from the electronically controlled expansion valve 4 is decompressed by heat exchange in the evaporator 5 made up of plate fins and a cooling pipe inserted therebetween and becomes low-temperature, low-pressure, two-phase gas-liquid refrigerant. The two-phase refrigerant discharged from the evaporator 5 flows into the accumulator 9, and gas refrigerant and liquid refrigerant are separated from each other. The gas refrigerant then returns to the compressor 1 and circulates through the main refrigerant circuit M.

Meanwhile, when defrosting operation starts, the solenoid valve 3 in the main refrigerant circuit M is closed, and the solenoid valve 10-A, the solenoid valve 10-B, and a solenoid valve 11 in the defrosting refrigerant circuit S are opened. Thus, high-temperature, high-pressure refrigerant discharged from the compressor 1 flows into the evaporator 5 through the defrosting refrigerant circuit S and defrosts or melts frost on the surface of the refrigerant pipe of the evaporator 5. That is, the cooling device closes the solenoid valve 3 in the main refrigerant circuit M before starting cooling operation. With the solenoid valve 3 being closed, the valve mechanism 16 in the defrosting refrigerant circuit S and the electronically controlled expansion valve 4 in the main refrigerant circuit M are opened. Afterwards, the valve mechanism 16 in the defrosting refrigerant circuit S is closed, and the solenoid valve 3 in the main refrigerant circuit M is opened. Cooling operation is then started.

Figure 2:
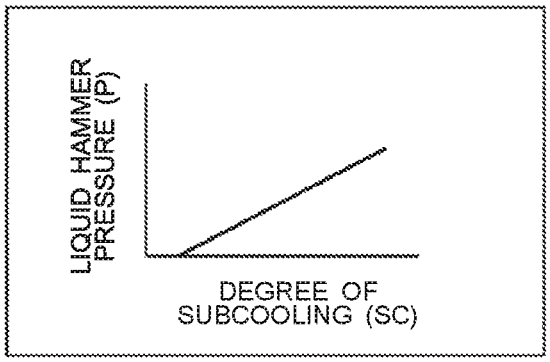
FIG. 2 is a graph showing an example of a relationship between the degree of subcooling of refrigerant and liquid hammer pressure in Embodiment 1 of the present invention.

FIG. 2 shows an example of a relationship between the degree of subcooling and liquid hammer pressure in Embodiment 1 of the present invention. As shown in FIG. 2, liquid hammer pressure P increases proportionately with an increase in the degree of subcooling SC detected by the subcooling degree detection unit 19 provided on the upstream side of the electronically controlled expansion valve 4. If the cooling device is operated in a state in which the degree of subcooling SC is high, refrigerant cannot sufficiently be evaporated or vaporized in the evaporation process of a refrigeration cycle in the main refrigerant circuit M. As a result, two-phase refrigerant flows from the evaporator 5. Such discharge of the two-phase refrigerant may cause liquid flood back to the compressor 1. In Embodiment 1, the solenoid valve 10-A, the solenoid valve 10-B, and the solenoid valve 11 in the defrosting refrigerant circuit S are opened before operation is switched to cooling operation, and cooling operation is then started. Thus, refrigerant circulates through the defrosting refrigerant circuit S before cooling operation. Accordingly, the pressure inside the defrosting refrigerant circuit S and the pressure inside the main refrigerant circuit M can be made uniform, or a pressure difference between the two circuits can be made extremely small. This decreases a pressure difference between the inlet side of the condenser 2 and the outlet side of the condenser 2 in the main refrigerant circuit M. As a result, even if the degree of subcooling SC is high, and therefore, even if the liquid hammer pressure P is high, a liquid hammer impact force that can be caused inside the main refrigerant circuit M can be suppressed, and impact on the solenoid valve 3 and the electronically controlled expansion valve 4 can be mitigated. It should be noted that impact is not applied to the electronically controlled expansion valve 4 without a pressure difference between the defrosting refrigerant circuit S and the main refrigerant circuit M. Moreover, by achieving the maximum opening of the electronically controlled expansion valve 4 before the solenoid valve 3 is opened, impact on the electronically controlled expansion valve 4 can be avoided, and consequently, a possibility of damaging the electronically controlled expansion valve 4 can be avoided.

The solenoid valve 10-A, the solenoid valve 10-B, and the solenoid valve 11 in the defrosting refrigerant circuit S are opened before cooling operation, but are not always opened under all the conditions. Whether it is necessary to open or close the solenoid valve 10-A, the solenoid valve 10-B, and the solenoid valve 11 is determined in accordance with the degree of subcooling SC, which is calculated from a difference between the outlet temperature of the condenser and a condensing temperature (described later with reference to FIG. 6). If the liquid hammer pressure P is low, the solenoid valve 10-A, the solenoid valve 10-B, and the solenoid valve 11 in the defrosting refrigerant circuit S are not opened. Instead, the maximum opening of only the electronically controlled expansion valve 4 is achieved.

Regarding the liquid flood back to the compressor 1 that can be caused by control (setting the opening degree to the maximum opening) performed when the electronically controlled expansion valve 4 is used, provision of the accumulator 9 in the main refrigerant circuit M enables operation in which liquid compression inside the compressor 1 due to the liquid flood back is suppressed and liquid refrigerant is not sucked into the compressor 1.

As described above, according to a principle that the liquid flood back can be avoided by using the accumulator 9, the gas refrigerant and the liquid refrigerant are separated from each other in the container of the accumulator 9, and only the gas refrigerant is caused to return to the compressor 1. The liquid refrigerant separated from the gas refrigerant and accumulated in the accumulator 9 and compressor oil are gradually sucked into the compressor 1 through an oil-returning hole in a U-shaped pipe provided in the container. This prevents a large amount of liquid refrigerant from flowing into the compressor 1.

Figure 3:
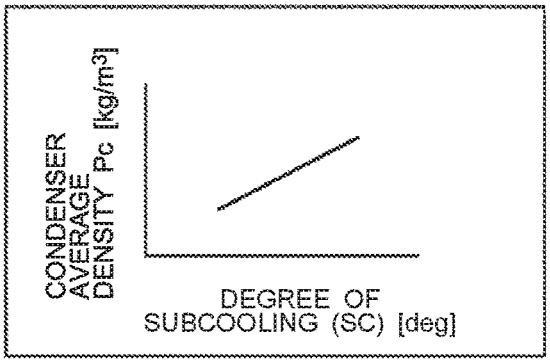
FIG. 3 is a graph showing an example of a relationship between the degree of subcooling of the refrigerant and the density of the refrigerant in Embodiment 1 of the present invention.

FIG. 3 shows an example of a relationship between the degree of subcooling and the density of refrigerant in Embodiment 1 of the present invention.

As shown in FIG. 3, the degree of subcooling SC increases proportionately with an increase in the density of refrigerant. Thus, it is understood that the liquid hammer pressure P also increases with an increase in the density of refrigerant as in the case of an increase in the degree of subcooling SC described above. This can also be easily estimated from expression (1) below for calculating the liquid hammer pressure P.

$$\text{Liquid hammer pressure } P = \text{density of refrigerant } \rho \times \text{sound velocity } C \times \text{flow velocity } V \quad (1)$$

According to expression (1), the liquid hammer pressure P increases or decreases in accordance with the density of refrigerant ρ. That is, as the density of refrigerant ρ decreases, the liquid hammer pressure P decreases, whereas as the density of refrigerant ρ increases, the liquid hammer pressure P increases. As the degree of subcooling SC increases, the density of refrigerant ρ increases. This is because that, as the degree of subcooling SC increases, liquid refrigerant does not boil at a temperature lower than a saturation temperature. That is, as refrigerant does not change from a liquid state to a gas state, the amount of liquid-state refrigerant increases, and the density of refrigerant ρ increases.

In Embodiment 1, as described with reference to FIG. 2, the solenoid valve 10-A, the solenoid valve 10-B, and the solenoid valve 11 in the defrosting refrigerant circuit S are opened before operation is switched to cooling operation, and cooling operation is then started. Thus, the refrigerant circulates through the defrosting refrigerant circuit S before cooling operation. Accordingly, the pressure inside the defrosting refrigerant circuit S and the pressure inside the main refrigerant circuit M can be made uniform, or a pressure difference between the two circuits can be made extremely small. This decreases a pressure difference between the inlet side of the condenser 2 and the outlet side of the condenser 2 in the main refrigerant circuit M. As a result, even if the density of refrigerant ρ is high, a liquid hammer impact force that can be caused inside the main refrigerant circuit M can be suppressed, and impact on the solenoid valve 3 and the electronically controlled expansion valve 4 can be mitigated.

Moreover, by achieving the maximum opening of the electronically controlled expansion valve 4 before the solenoid valve 3 is opened, impact on the electronically controlled expansion valve 4 can be avoided, and consequently, a possibility of damaging the electronically controlled expansion valve 4 can be avoided. That is, the liquid hammer pressure P can be suppressed from being applied to the electronically controlled expansion valve 4 irrespective of the density of refrigerant p.

Figure 4:
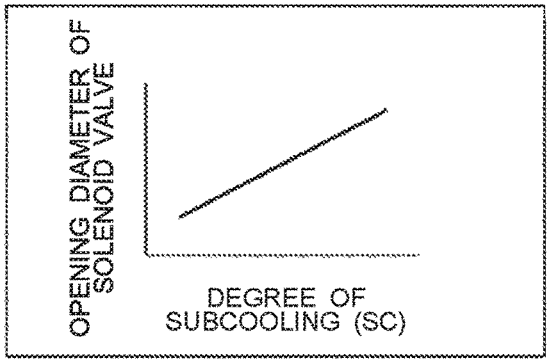
FIG. 4 is a graph showing an example of a relationship between the degree of subcooling of the refrigerant and the opening diameter of a solenoid valve in a main refrigerant circuit in Embodiment 1 of the present invention.

FIG. 4 is an example of a relationship between the degree of subcooling SC and the opening diameter of the solenoid valve 3 in Embodiment 1 of the present invention.

As shown in FIG. 4, the degree of subcooling SC increases proportionately with an increase in the opening diameter of the solenoid valve 3. Thus, it is understood that the liquid hammer pressure P also increases with an increase in the opening diameter of the solenoid valve 3 as in the case of an increase in the degree of subcooling SC described above. This is related to an effect of refrigerant decompression in accordance with the opening diameter of the solenoid valve 3. Refrigerant is decompressed when passing through the solenoid valve 3. Thus, the smaller the opening diameter of the solenoid valve 3, the lower the amount of circulating refrigerant. A decrease in the amount of circulating refrigerant means a decrease in the flow velocity of the refrigerant flowing through the main refrigerant circuit M.

As described above with reference to FIG. 3, the liquid hammer pressure P can be obtained from expression (1) above. According to expression (1) above, the liquid hammer pressure P increases or decreases in accordance with the flow velocity V of the refrigerant. The lower the flow velocity V of the refrigerant is, the lower the liquid hammer pressure P is, whereas the higher the flow velocity V of the refrigerant is, the higher the liquid hammer pressure P is. Differences in the amount of circulating refrigerant in accordance with the opening diameter of the solenoid valve 3 lead to an increase in the liquid hammer pressure P. In Embodiment 1, because of a large opening diameter of the solenoid valve 3, the amount of circulating refrigerant is large, and the flow velocity V is high. Thus, the liquid hammer pressure P is high. As described with reference to FIG. 2, the solenoid valve 10-A, the solenoid valve 10-B, and the solenoid valve 11 in the defrosting refrigerant circuit S are opened before operation is switched to cooling operation, and cooling operation is then started. Thus, refrigerant circulates through the defrosting refrigerant circuit S before cooling operation. Accordingly, the pressure inside the defrosting refrigerant circuit S and the pressure inside the main refrigerant circuit M can be made uniform, or a pressure difference between the two circuits can be made extremely small. This decreases a pressure difference between the inlet side of the condenser 2 and the outlet side of the condenser 2 in the main refrigerant circuit M. As a result, even if the amount of circulating refrigerant is large due to a large opening diameter of the solenoid valve 3, even if the flow velocity V is high, and therefore, even if the liquid hammer pressure P is high, a liquid hammer impact force that can be caused inside the main refrigerant circuit M can be suppressed, and impact on the solenoid valve 3 and the electronically controlled expansion valve 4 can be mitigated. Moreover, by achieving the maximum opening of the electronically controlled expansion valve 4 before the solenoid valve 3 is opened, impact on the electronically controlled expansion valve 4 can be avoided, and consequently, a possibility of damaging the electronically controlled expansion valve 4 can be avoided.

Accordingly, when determining the opening diameter of the solenoid valve 3, there is no need to change the diameter in consideration of the liquid hammer pressure P. Furthermore, since there is no need for the solenoid valve 3 to control the amount of circulating refrigerant, the main refrigerant circuit M can be optimized by the electronically controlled expansion valve 4 performing control to regulate the amount of circulating refrigerant.

Distinct operation in Embodiment 1 will be described below with reference to FIGS. 5 and 6.

Figure 5:
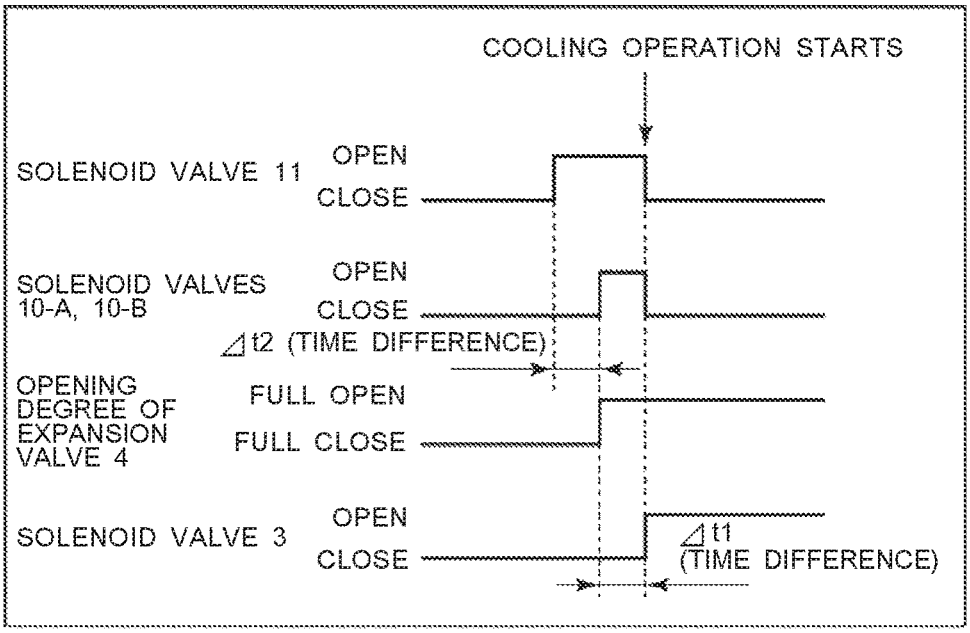
FIG. 5 is a timing diagram showing an example of opening-closing timing of an electronically controlled expansion valve and the solenoid valve in the main refrigerant circuit and opening-closing timing of solenoid valves in a defrosting refrigerant circuit in Embodiment 1 of the present invention.

FIG. 5 is a timing diagram showing an example of opening-closing timing of the electronically controlled expansion valve 4 and the solenoid valve 3 and opening-closing timing of the solenoid valve 10-A, the solenoid valve 10-B, and the solenoid valve 11 in the defrosting refrigerant circuit S in Embodiment 1 of the present invention.

Before the cooling device according to the present invention enters a cooling operation state, a time difference Δt1 is specified so that the solenoid valve 3 is opened after the maximum opening (full opening) of the electronically controlled expansion valve 4 is achieved to regulate the opening degree of the electronically controlled expansion valve 4. By so doing, high-pressure refrigerant flowing through a high-pressure liquid pipe 6 on the upstream side of the solenoid valve 3 and high-pressure refrigerant flowing through a high-pressure liquid pipe 7 on the downstream side of the solenoid valve 3, in the direction in which the refrigerant flows, are suppressed from colliding with the electronically controlled expansion valve 4, thereby avoiding abrupt impact on the electronically controlled expansion valve 4.

Moreover, opening-closing timing of the solenoid valve 10-A, the solenoid valve 10-B, and the solenoid valve 11 is specified in a case in which the solenoid valve 10-A, the solenoid valve 10-B, and the solenoid valve 11 in the defrosting refrigerant circuit S are opened before cooling operation, and the cooling device then enters a cooling operation state, thereby causing the pressure inside the defrosting refrigerant circuit S and the pressure inside the main refrigerant circuit M to be a uniform pressure, or causing a pressure difference between the two circuits to be extremely small. In this case, in a manner similar to avoiding the abrupt impact on the electronically controlled expansion valve 4, a time difference Δt2 is specified so that the solenoid valve 10-A and the solenoid valve 10-B are opened after the solenoid valve 11 is opened, thereby avoiding impact due to high-pressure refrigerant being applied to the solenoid valve 11. It should be noted that operation of operating devices based on the time difference Δt1 and the time difference Δt2 is performed in accordance with time measured by the time counter T of the controller 21.

Figures 6, 7:
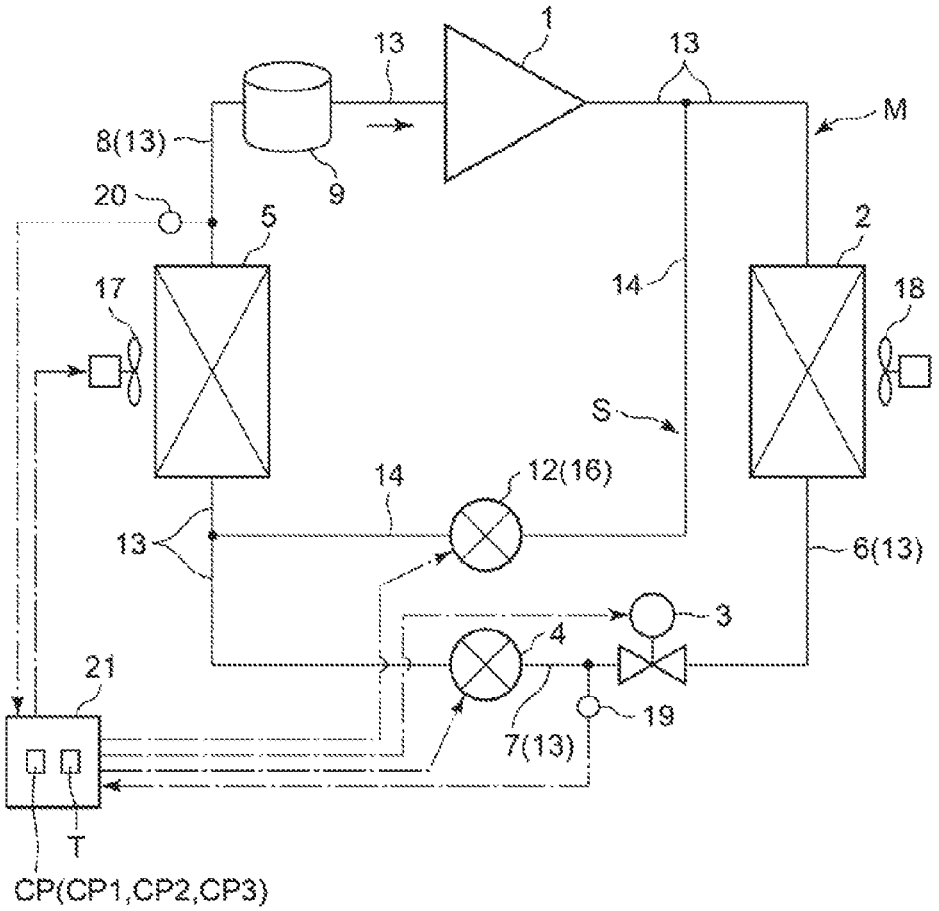
FIG. 6 is a diagram for explaining an example of opening and closing control of the electronically controlled expansion valve and the solenoid valve in the main refrigerant circuit and the solenoid valves in the defrosting refrigerant circuit in accordance with the degree of subcooling of the refrigerant in Embodiment 1 of the present invention.
FIG. 7 is a schematic circuit block diagram showing a cooling device in Embodiment 2 of the present invention.

FIG. 6 shows an example of opening and closing control of the solenoid valve 10-A, solenoid valve 10-B, and the solenoid valve 11 in the defrosting refrigerant circuit S and the solenoid valve 3 and the electronically controlled expansion valve 4 in the main refrigerant circuit M in accordance with the degree of subcooling in Embodiment 1 of the present invention.

The second control unit CP2 described above has a function of controlling the driving of the solenoid valve 10-A, the solenoid valve 10-B, and the solenoid valve 11 in the defrosting refrigerant circuit S and the solenoid valve 3 and the electronically controlled expansion valve 4 in the main refrigerant circuit M. When cooling operation starts, the second control unit CP2 controls the flow rate of refrigerant flowing through the solenoid valve 10-A and the flow rate of refrigerant flowing through the solenoid valve 10-B in the defrosting refrigerant circuit S in accordance with the degree of subcooling SC detected by the subcooling degree detection unit 19. When the degree of subcooling SC before cooling operation is high (e.g., 20 K<degree of subcooling), the second control unit CP2 fully opens all of the solenoid valve 10-A, the solenoid valve 10-B, and the solenoid valve 11 in the defrosting refrigerant circuit S. Since a pressure difference between the inlet side of the condenser 2 and the outlet side of the condenser 2 before cooling operation is large, the amount of refrigerant circulating through the defrosting refrigerant circuit S is increased. By so doing, the pressure inside the defrosting refrigerant circuit S and the pressure inside the main refrigerant circuit M are made uniform, or a pressure difference between the two circuits is made extremely small. This decreases the pressure difference between the inlet side of the condenser 2 and the outlet side of the condenser 2 in the main refrigerant circuit M. If the degree of subcooling SC before cooling operation is intermediate (e.g., 10 K<degree of subcooling<20 K), the second control unit CP2 opens the solenoid valve 10-A and the solenoid valve 11 in the defrosting refrigerant circuit S.

If the degree of subcooling SC before cooling operation is low (e.g., degree of subcooling<10 K), the second control unit CP2 does not open the solenoid valve 10-A, the solenoid valve 10-B, or the solenoid valve 11 in the defrosting refrigerant circuit S, but opens the solenoid valve 3 in the main refrigerant circuit M.

According to the control described above, when the degree of subcooling SC is high, to avoid liquid hammer impact, all of the solenoid valve 10-A, the solenoid valve 10-B, and the solenoid valve 11 are fully opened, and operation is then switched to cooling operation. Thus, refrigerant circulates through the defrosting circuit S before cooling operation. Accordingly, the pressure inside the defrosting refrigerant circuit S and the pressure inside the main refrigerant circuit M are made uniform, or a pressure difference between the two circuits is made extremely small. This can decrease a pressure difference between the inlet side of the condenser 2 and the outlet side of the condenser 2 in the main refrigerant circuit M. Meanwhile, when the degree of subcooling is not high, the opening and closing control of the solenoid valve 10-A and the solenoid valve 10-B is performed in accordance with the degree of subcooling SC to regulate the amount of refrigerant circulating through the defrosting refrigerant circuit S. This can also decrease a pressure difference between the inlet side of the condenser 2 and the outlet side of the condenser 2 in the main refrigerant circuit M. Moreover, reliability for the number of guaranteed operating times of the solenoid valve 10-A, the solenoid valve 10-B, and the solenoid valve 11 can be improved. The solenoid valve 10-A, the solenoid valve 10-B, and the solenoid valve 11 in the defrosting refrigerant circuit S are fully opened before operation is switched to cooling operation, and cooling operation is then started. Thus, refrigerant circulates through the defrosting refrigerant circuit S before cooling operation. Accordingly, the pressure inside the defrosting refrigerant circuit S and the pressure inside the main refrigerant circuit M can be made uniform, or a pressure difference between the two circuits can be made extremely small. This can decrease a pressure difference between the inlet side of the condenser 2 and the outlet side of the condenser 2 in the main refrigerant circuit M. As a result, a liquid hammer impact force that can be caused inside the main refrigerant circuit M can be suppressed, and impact on the solenoid valve 3 and the electronically controlled expansion valve 4 can be mitigated.

As described above, when the cooling device enters the cooling operation state, the flow rate of refrigerant in each of the solenoid valve 10-A and the solenoid valve 10-B is variable, and the maximum opening of the electronically controlled expansion valve 4 in the main refrigerant circuit M is achieved. Thus, damage to the electronically controlled expansion valve 4 can be suppressed. The amount of heat necessary for performing defrosting operation can be increased by opening both the solenoid valve 10-A and the solenoid valve 10-B in the defrosting refrigerant circuit S during defrosting operation. Thus, it is a matter of course that a defrosting time can be shortened.

It should be noted that Embodiment 1 is an example in which the valve mechanism 16 in the defrosting refrigerant circuit is made up of two valves connected in parallel, the solenoid valve 10-A and the solenoid valve 10-B (sub-opening-closing valves) that are either fully opened or fully closed. However, the present invention is not limited to this configuration. The valve mechanism may be made up of at least three sub-opening-closing valves that are connected in parallel relative to the defrosting refrigerant circuit and that are either fully opened or fully closed.

Embodiment 2

In Embodiment 1, two valves, the solenoid valve 10-A and the solenoid valve 10-B for which either full opening or full closing is selected are provided as the valve mechanism 16 in the defrosting refrigerant circuit S. Meanwhile, in Embodiment 2, a valve mechanism 16 that is not a solenoid valve for which either full opening or full closing is selected is provided in a defrosting refrigerant circuit S to obtain effects equivalent to those described in Embodiment 1. Hereinafter, Embodiment 2 for obtaining such effects will be described.

FIG. 7 shows a refrigerant circuit in Embodiment 2 of the present invention.

In FIG. 7, an electronically controlled expansion valve 12 (control valve in the present invention) whose opening degree of the valve is variably controlled in accordance with an electrical signal is provided in the defrosting circuit S as the valve mechanism 16 instead of the solenoid valve 10-A and the solenoid valve 10-B. A cooling device in Embodiment 2 differs from the cooling device in Embodiment 1 in this respect. It should be noted that as in the case of the electronically controlled expansion valve 4 described above, the electronically controlled expansion valve 12 is a valve (what is called LEV) in which the flow rate of refrigerant can be controlled substantially without taking steps from a full open state to a full close state in accordance with an electrical signal issued from the controller 21.

When the cooling device enters a cooling operation state, the pressure inside a high-pressure liquid pipe 6 is made to be high, and when a solenoid valve 3 is opened, refrigerant flows from the inside of the high-pressure liquid pipe 6. The cooling device in Embodiment 2 mitigates abrupt impact (liquid hammer) on an electronically controlled expansion valve 4 due to this refrigerant, thereby suppressing damage to the electronically controlled expansion valve 4. Thus, the cooling device in Embodiment 2 can obtain effects similar to those obtained in Embodiment 1.

That is, the opening degree of the electronically controlled expansion valve 12 in a defrosting refrigerant circuit S is regulated before operation is switched to cooling operation, and cooling operation is then started. Thus, refrigerant circulates through the defrosting refrigerant circuit S before cooling operation. Accordingly, the pressure inside the defrosting refrigerant circuit S and the pressure inside a main refrigerant circuit M can be made uniform or a pressure difference between the two circuits can be made extremely small. This decreases a pressure difference between the inlet side of a condenser 2 and the outlet side of the condenser 2 in the main refrigerant circuit M. As a result, even if degree of subcooling SC is high, and therefore, even if liquid hammer pressure P is high, a liquid hammer impact force that can be caused inside the main refrigerant circuit M can be suppressed, and impact on the solenoid valve 3 and the electronically controlled expansion valve 4 can be mitigated. Moreover, by achieving the maximum opening of the electronically controlled expansion valve 4 before the solenoid valve 3 is opened, impact on the electronically controlled expansion valve 4 can be avoided, and consequently, a possibility of damaging the electronically controlled expansion valve 4 can be avoided.

The opening degree of the electronically controlled expansion valve 12 in the defrosting refrigerant circuit S is regulated before cooling operation, but is not always regulated under all the conditions. The degree of subcooling is calculated from a difference between the outlet temperature of the condenser 2 and a condensing temperature, and the opening degree is determined in accordance with the degree of subcooling (described later with reference to FIG. 9).

Hereinafter, operation will be described with reference to FIGS. 8 and 9.

Figures 8, 9:
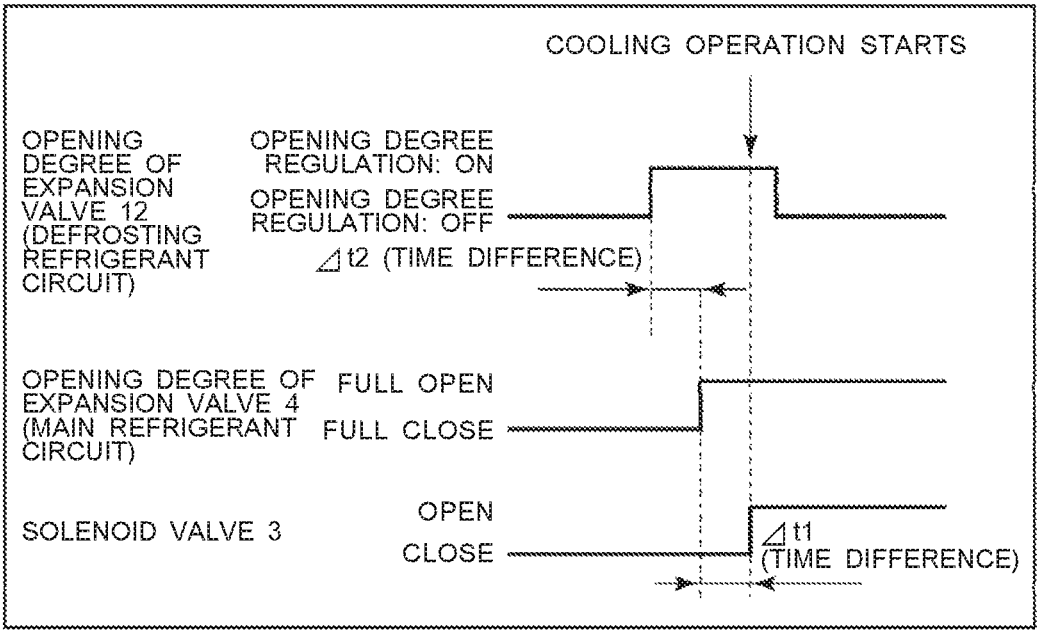
FIG. 8 is a timing diagram showing an example of opening-closing timing of an electronically controlled expansion valve and a solenoid valve in a main refrigerant circuit and a solenoid valve in a defrosting refrigerant circuit in Embodiment 2 of the present invention.
FIG. 9 is a diagram for explaining an example of opening and closing control of the electronically controlled expansion valve and the solenoid valve in the main refrigerant circuit and the solenoid valve in the defrosting refrigerant circuit in accordance with the degree of subcooling of refrigerant in Embodiment 2 of the present invention.

FIG. 8 is a timing diagram showing an example of opening-closing timing of the solenoid valve 3 and the electronically controlled expansion valve 4 in the main refrigerant circuit M and the electronically controlled expansion valve 12 in the defrosting refrigerant circuit S in Embodiment 2 of the present invention.

Before the cooling device according to the present invention enters an operation state, a time difference Δt1 is specified so that the solenoid valve 3 is opened after the maximum opening of the electronically controlled expansion valve 4 is achieved to regulate the opening degree of the electronically controlled expansion valve 4. By so doing, refrigerant flowing through the high-pressure liquid pipe 6 provided on the upstream side of the solenoid valve 3 and refrigerant flowing through a high-pressure liquid pipe 7 provided on the downstream side of the solenoid valve 3 do not collide with the electronically controlled expansion valve 4. Accordingly, abrupt impact on the electronically controlled expansion valve 4 can be avoided.

Moreover, as a time difference Δt2, the opening-closing timing of the electronically controlled expansion valve 12 and the electronically controlled expansion valve 4 is specified in a case in which the opening degree of the electronically controlled expansion valve 12 in the defrosting refrigerant circuit S is regulated before cooling operation, and the cooling device then enters the cooling operation state, thereby causing the pressure inside the defrosting refrigerant circuit S and the pressure inside the refrigerant circuit M to be a uniform pressure, or causing a pressure difference between the two circuits to be extremely small.

FIG. 9 shows an example of opening and closing control of the solenoid valve 3 and the electronically controlled expansion valve 4 in the main refrigerant circuit M and the electronically controlled expansion valve 12 in the defrosting refrigerant S in accordance with the degree of subcooling in Embodiment 2 of the present invention.

Also, in this case, if the degree of subcooling SC before operation is high (e.g., 20 K<degree of subcooling), a second control unit CP2 fully opens the electronically controlled expansion valve 12 in the defrosting refrigerant S. As a pressure difference between the inlet side of the condenser 2 and the outlet side of the condenser 2 before cooling operation is large, the amount of refrigerant circulating through the defrosting refrigerant circuit S is increased. Accordingly, the pressure inside the defrosting refrigerant circuit S and the pressure inside the main refrigerant circuit M are made uniform, or a pressure difference between the two circuits is made extremely small. This decreases a pressure difference between the inlet side of the condenser 2 and the outlet side of the condenser 2 in the main refrigerant circuit M.

If the degree of subcooling SC before operation is intermediate (e.g., 10 K<degree of subcooling<20 K), the second control unit CP2 makes the electronically controlled expansion valve 12 in the defrosting refrigerant circuit S half open.

If the degree of subcooling SC before operation is low (e.g., degree of subcooling<10 K), the second control unit CP2 does not regulate the opening degree of the electronically controlled expansion valve 12 in the defrosting refrigerant circuit S, but controls the solenoid valve 3 in the main refrigerant circuit M.

According to the control above, if the degree of subcooling SC is high, to avoid liquid hammer impact, the electronically controlled expansion valve 12 is opened, and operation is then switched to cooling operation. Thus, refrigerant circulates through the defrosting refrigerant circuit S before cooling operation. Accordingly, the pressure inside the defrosting refrigerant circuit S and the pressure inside the main refrigerant circuit M are made uniform, or a pressure difference between the two circuits is made extremely small. This can decrease a pressure difference between the inlet side of the condenser 2 and the outlet side of the condenser 2 in the main refrigerant circuit M. If the degree of subcooling SC is not high, the opening degree of the electronically controlled expansion valve 12 is controlled in accordance with the degree of subcooling SC, and the amount of refrigerant circulating through the defrosting refrigerant circuit S is regulated. This can also decrease the pressure difference between the inlet side of the condenser 2 and the outlet side of the condenser 2 in the main refrigerant circuit M.

Also for the cooling device in Embodiment 2, as in the case of Embodiment 1, a pressure difference between the inlet side of the condenser 2 and the outlet side of the condenser 2 in the main refrigerant circuit M is decreased by effects of the electronically controlled expansion valve 12, which is the valve mechanism 16. Accordingly, it is a matter of course that a liquid hammer impact force that can be caused in the main refrigerant circuit M can be suppressed, and consequently, impact on the solenoid valve 3 and the electronically controlled expansion valve 4 can be mitigated. Additionally, as the valve mechanism 16 is made of the electronically controlled expansion valve 12, the number of components can be reduced, thereby making the structure itself simple and simplifying the control system. Thus, minute control can be performed.

As such, when the cooling device enters the operation state, the maximum opening of the electronically controlled expansion valve 4 is achieved. This can suppress damage to the electronically controlled expansion valve 4. It is a matter of course that, by fully opening the electronically controlled expansion valve 12 in the defrosting refrigerant circuit S during defrosting operation, the amount of heat necessary for defrosting is increased, and a defrosting time can be shortened.

Embodiment 3

In Embodiments 1 and 2, if circuit capacity on the low-pressure side is increased by providing the accumulator 9, which becomes a factor of a low rate of increase in low pressure (pressure of refrigerant), setting of the amount of air sent by the air-sending fan 17 can be changed, for example. That is, the third control unit CP3 of the controller CP in the controller 21 above has a function of implementing a control program for controlling the amount of air sent to the evaporator 5 by the air-sending fan 17 in accordance with the pressure of refrigerant LP detected by the low-pressure detection unit 20.

In a cooling device in Embodiment 3, a third control unit CP3 controls the amount of air sent by an air-sending fan 17. Thus, if pressure of refrigerant LP detected by a low-pressure detection unit 20 does not become high, the third control unit CP3 changes the air-sending mode, for example, from a weak notch (soft wind mode) to a strong notch (strong wind mode) to increase the amount of air to be sent. In this way, the amount of heat exchange in an evaporator 5 is increased to increase the amount of circulating refrigerant, thereby suppressing a decrease in refrigeration capacity. It should be noted that an accumulator 9 is a pressure container for protecting a compressor 1 from liquid flood back that occurs due to, for example, an abrupt change in a load and is provided in a refrigerant pipe 13 that connects the evaporator 5 and the compressor 1 to each other. Here, a principle to protect from the liquid flood back by using the accumulator 9 will be described. Gas refrigerant and liquid refrigerant are separated from each other inside the accumulator container. Then, only the gas refrigerant is caused to return to the compressor 1, and the liquid refrigerant separated from the gas refrigerant and accumulated in the container and compressor oil are gradually sucked into the compressor 1 through an oil-returning hole in a U-shaped pipe provided in the container. In this way, a large amount of liquid refrigerant is suppressed from flowing into the compressor 1.

The invention claimed is:

1. A cooling device comprising:

a main refrigerant circuit in which a compressor, a condenser, a main opening-closing valve, an expansion valve, and an evaporator are sequentially connected via refrigerant pipes, the main opening-closing valve being fully opened or fully closed, and the expansion valve being a valve in which a flow rate of refrigerant is variable;

a defrosting refrigerant circuit that connects a refrigerant outlet side of the compressor in the main refrigerant circuit and a refrigerant inlet side of the evaporator in the main refrigerant circuit to each other and that includes a valve mechanism in a path of the defrosting refrigerant circuit; and a controller configured to selectively control the valve mechanism in the defrosting refrigerant circuit and the expansion valve and the main opening-closing valve in the main refrigerant circuit to reduce a pressure difference between the main refrigerant circuit and the defrosting refrigerant circuit before a start of a cooling operation by:

opening the valve mechanism to cause high-pressure refrigerant to flow from the compressor to the evaporator via the defrosting refrigerant circuit, opening the expansion valve at a first predetermined time after opening the valve mechanism, opening the main opening-closing valve at a second predetermined time after opening the expansion valve to start the cooling operation, and closing the valve mechanism.

2. The cooling device of claim 1, further comprising a subcooling degree detector that calculates a degree of subcooling on an upstream side of the expansion valve from a difference between an outlet temperature of the condenser and a condensing temperature.

3. The cooling device of claim 2, wherein in the valve mechanism of the defrosting refrigerant circuit, a flow rate of refrigerant is variable, and the controller regulates an amount of refrigerant flowing through the valve mechanism in accordance with the degree of subcooling.

4. The cooling device of claim 3, wherein the valve mechanism in the defrosting refrigerant circuit includes sub-opening-closing valves that are fully opened or fully closed, and the sub-opening-closing valves are connected in parallel relative to the defrosting refrigerant circuit.

5. The cooling device of claim 3, wherein the valve mechanism in the defrosting refrigerant circuit is an electronically controlled expansion valve having a variably controlled opening degree.

6. The cooling device of claim 1, further comprising:

a low-pressure detector that detects pressure of refrigerant on a downstream side of the evaporator in the main refrigerant circuit in a direction in which the refrigerant flows;

an accumulator that is provided on the downstream side of the evaporator in the main refrigerant circuit in the direction in which the refrigerant flows; and an air-sending fan that sends air to the evaporator, wherein the controller controls an amount of air sent by the air-sending fan in accordance with the pressure of refrigerant detected by the low-pressure detector.

* * * * *